US006795680B2

(12) United States Patent
Yokoi et al.

(10) Patent No.: US 6,795,680 B2
(45) Date of Patent: Sep. 21, 2004

(54) FIXING DEVICE AND IMAGE FORMING DEVICE PROVIDED WITH THE SAME

(75) Inventors: Katsuyuki Yokoi, Iwakura (JP); Masashi Suzuki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/424,064

(22) Filed: Apr. 28, 2003

(65) Prior Publication Data

US 2003/0202826 A1 Oct. 30, 2003

(30) Foreign Application Priority Data

Apr. 30, 2002 (JP) ..... 2002-128570

(51) Int. Cl.[7] ..... G03G 15/20
(52) U.S. Cl. ..... 399/333; 219/216; 399/69
(58) Field of Search ..... 219/216; 347/156; 399/67, 69, 320, 328, 330, 324, 333

(56) References Cited

U.S. PATENT DOCUMENTS 4,821,069 A * 4/1989 Kusumoto ..... 219/216
5,329,342 A * 7/1994 Shirai et al. ..... 399/33
5,819,136 A * 10/1998 Tomita et al. ..... 399/69
6,684,037 B2 * 1/2004 Tamaoki ..... 399/69

FOREIGN PATENT DOCUMENTS

JP A 6-118837 4/1994
JP A 2001-109316 4/2001

* cited by examiner

*Primary Examiner*—Hoang Ngo
(74) *Attorney, Agent, or Firm*—Oliff & Berridge, PLC

(57) ABSTRACT

A fixing device has a fixing unit and a temperature detection unit. The fixing unit includes a heat roller provided with a roller section and a heater section, and a pressure roller in pressure contact with the heat roller. These rollers are disposed in a protective cover. The roller section includes a base layer of aluminum formed into a hollow cylindrical shape, a black radiation layer, and a toner parting layer. The heater section is disposed in a hollow space of the base layer. In this heat roller, when heat is emitted from the heater section, and the heat is transmitted to the radiation layer via the base layer, greater amount of infrared radiation is emitted from the radiation layer than in the case of a heat roller that is not equipped with the radiation layer. The temperature detecting unit includes an infrared radiation sensor. Thus, even if a noise component is absorbed to some extent by locating the sensor at a distance from the heat roller on an outside of the protective cover, the temperature of the heat roller is detected accurately.

71 Claims, 6 Drawing Sheets

FIXING DEVICE AND IMAGE FORMING DEVICE PROVIDED WITH THE SAME

BACKGROUND OF THE INVENTION

The present invention relates to a fixing device that fixes a fixable medium such as a toner image on a receiving medium such as printing paper, and an image forming device equipped with this fixing device.

A conventional fixing device includes a heat roller that fixes a toner image transferred to printing paper onto printing paper, and a pressure roller that holds the printing paper between itself and the heat roller. The heat roller includes a hollow cylindrical aluminum roller body, a heater such as a halogen lamp disposed inside the roller body, and a toner parting layer formed over an outer peripheral surface of the roller body and made of a parting agent or release agent that prevents toner from being adhered onto the outer peripheral surface. Thus, when heat is emitted from the heater, that heat is conveyed to the printing paper in contact with the outer surface of the heat roller via the roller body and the toner parting layer, the toner forming the toner image transferred to that printing paper is melted, and the toner image is fixed onto the printing paper.

On the other hand, the pressure roller is formed from a flexible resin such as silicone rubber, and is positioned so as to exert pressure on the heat roller. The pressure roller forms a nip for reliably conveying heat emitted by the heat roller to the printing paper. Thus, while the printing paper is passing through the nip, pressure from the pressure roller is exerted on the heat roller, and as a result, the heat necessary for fixing the toner image onto the printing paper is reliably conveyed from the heat roller to the printing paper.

The fixing device is also equipped with a temperature sensor that monitors the temperature of the outer surface of the heat roller, and a control device that controls the operation of the heater based on the results of monitoring by that temperature sensor, so that the outer surface of the heat roller is at the proper temperature for fixing the toner image onto the printing paper. In this way, the problems known as offset and defective fixing are avoided. Off-set refers to a case where the temperature of the heat roller is too high, the toner melts more than is necessary and adheres to the outer surface of the heat roller, the adhering toner circulates around the heat roller, and toner is fixed in areas of the printing paper where toner was not originally transferred. Defective fixing refers to a case where the temperature of the heat roller is too low and toner is not completely fixed onto the printing paper, so that the toner image peels away from the printing paper after printing is completed.

The temperature sensor used in a fixing device may be a contact-type sensor such as a thermistor, or a non-contact type infrared sensor such as a thermopile. The contact-type sensor senses the temperature of the outer surface of the heat roller through direct contact with the outer surface of the heat roller. The non-contact type infrared sensor is positioned at a distance from the heat roller, and receives a bundle of infrared radiation emitted from the outer surface of the heat roller so as to sense the temperature of the outer surface of the heat roller based on the received bundle of infrared radiation.

Which of these is used depends on the design. Generally, however, when the toner that adheres to the surface of the heat roller is so fine that it is not recognizable as offset even if it is fixed onto the printing paper. In this case, if the contact-type sensor is used, toner is scraped off by the sensor, and when the amount scraped off reaches a certain level, it flows out all at once, and the outflowing toner adheres to the printing paper. For this reason, the use of non-contact type infrared sensors as temperature sensors has been proposed in recent years.

A typical thermopile used as a non-contact type infrared sensor has a low heat-resistance temperature, and must be positioned at a certain distance away from the heat roller in order to perform accurate detection of the heat roller temperature. However, when the thermopile is positioned at a distance from the heat roller, objects other than the heat roller fall within the angle of field view of the thermopile. As a result, the thermopile also detects infrared radiation emitted from objects other than the heat roller, in addition to infrared radiation emitted from the heat roller (such infrared radiation which is not the object of detection is hereinafter referred to as a "noise component"). This noise component degrades detection of the heat roller temperature.

Also, the color of the housing of a fixing device is generally black, and the amount of infrared radiation is comparatively large. Therefore, with a fixing device equipped with a black housing, there is a strong tendency for a thermopile to be adversely affected by infrared radiation emitted from other than the heat roller.

SUMMARY OF THE INVENTION

It is an object of the present invention to overcome the above-described problems, and to provide an improved fixing device capable of accurately detecting the temperature of a fixing component using a non-contact type temperature detector typified by a thermopile.

Another object of the present invention is to provide an image forming device equipped with the improved fixing device to thus provide improved imaging quality without offset and defective fixing.

These and other objects of the present invention will be attained by a fixing device for heatingly fixing a fixable medium to a receiving medium, including an improved fixing unit, and a temperature sensor unit. The fixing unit heats and presses the fixable medium onto the receiving medium. The fixing unit emits infrared radiation as a result of heating and provides a lamination structure component including at least a base layer having a surface and a radiation layer with an infrared emissivity higher than that of the surface of the base layer. The temperature sensor unit detects a temperature of the fixing unit based on the infrared radiation, and positioned spaced away from the fixing unit while enabling reception of the infrared radiation emitted from the radiation layer.

In another aspect of the invention, there is provided an a fixing device for heatingly fixing a fixable medium to a receiving medium, including a fixing unit, a protective cover, and a temperature sensor unit. The fixing unit heats and presses the fixable medium onto the receiving medium, and the fixing unit emits infrared radiation as a result of heating with its infrared emissivity. The protective cover covers the fixing unit. The temperature sensor unit detects a temperature of the fixing unit based on the infrared radiation and positioned spaced away from the fixing unit while enabling reception of the infrared radiation emitted from the radiation layer. The temperature sensing unit has a light receiving surface providing a field of view, and the protective cover has an area viewable within the field of view. At least a part of the area has an infrared emissivity lower than that of the fixing unit.

DETAILED DESCRIPTION OF THE PREFERRED EMBODIMENTS

A laser printer and a fixing device incorporated therein according to a first embodiment of the present invention will be described with reference to FIGS. 1 through 4.

Figure 1:
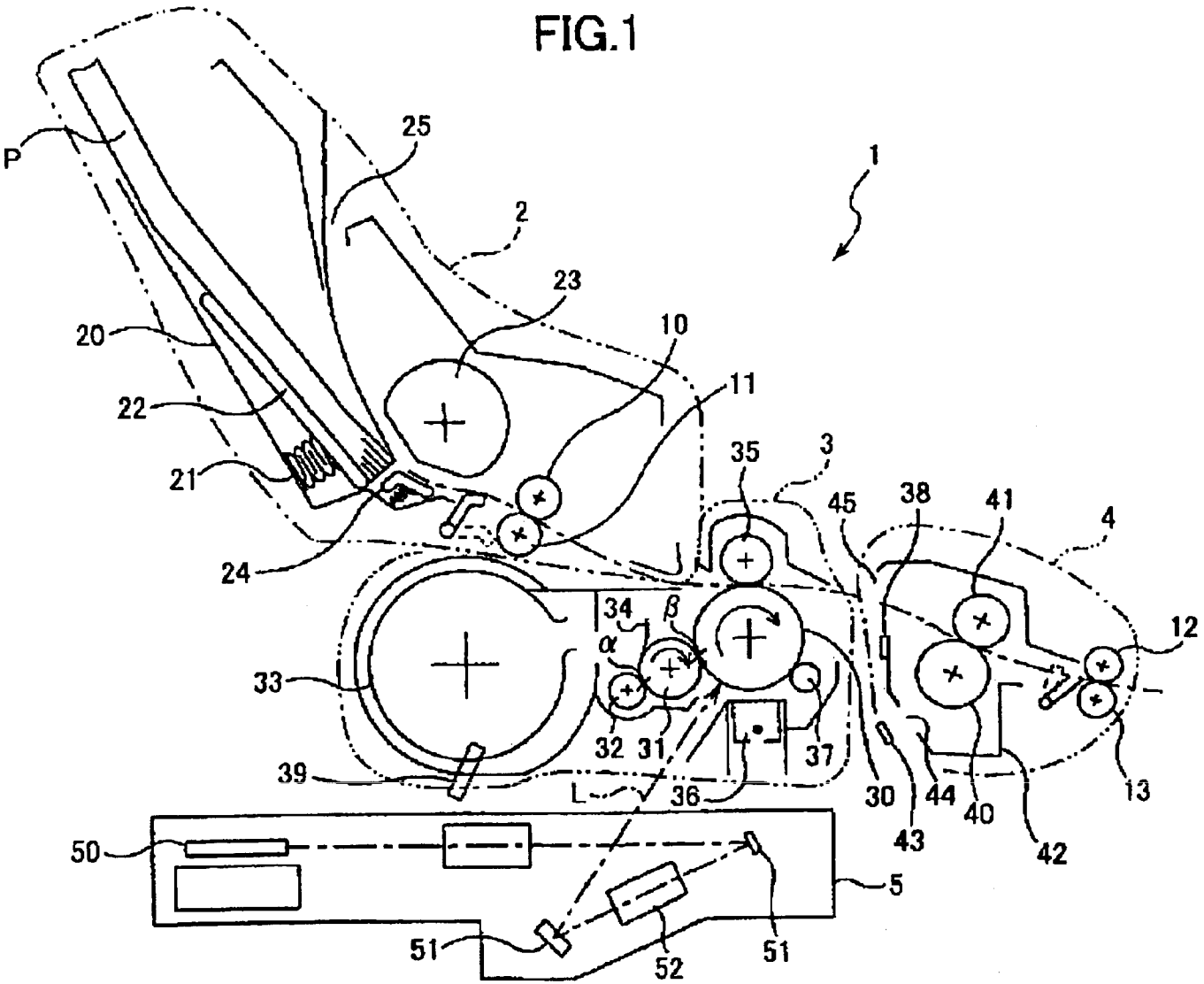
FIG. 1 is a schematic diagram showing a laser printer according to a first embodiment of the present invention.

Generally, a laser printer receives image data transmitted from a personal computer, word processor, or the like, via a cable, and forms an image on a recording paper in accordance with that data. As shown in FIG. 1, the laser printer 1 includes a paper supply unit 2 that supplies printing paper P, which is a recording paper (receiving medium), and a developing unit 3 that transfers a toner image developed on a photosensitive drum 30 as an electrostatic latent bearing member, to the printing paper P supplied from this paper supply unit 2. In addition, the laser printer 1 includes a fixing device 4 that fixes a toner image, transferred to printing paper P by the developing unit 3, onto the printing paper P, and a scanner unit 5 that forms the electrostatic latent image on the photosensitive drum 30 by applying a laser beam in accordance with the image data.

The paper supply unit 2 includes a feeder case 20, in which printing papers P are set in stacked form, and a paper supply roller 23 is disposed at an outlet end of the feeder case 20. The paper supply roller 23 is driven by a drive source (not shown). Further, a separation pad 24 is disposed immediately below the paper supply roller 23. A supporting plate 22 is pivotally movably disposed in the feeder case 20, and a compression spring 21 is interposed between a bottom of the feeder case 20 and the supporting plate 22 for urging one end of the supporting plate 22 toward the paper supply roller 23. A pair of register rollers 10 and 11 are disposed downstream of the paper supply roller 23.

A leading edge of the printing paper P is pressed toward the paper supply roller 23 by the supporting plate 22 forced by the compression spring 21. As a result, an uppermost printing paper P in the sheet stack is supplied by the rotation of the paper supply roller 23 and a separation pad 24, and can be conveyed to the pair of upper and lower register rollers 10 and 11. The paper supply unit 2 is provided with a manual insertion port 25 that opens in an oblique upward direction, allowing recording paper separate from the printing paper P in the feeder case 20 to be inserted and printed upon.

The developing unit 3 includes the photosensitive drum 30, a transfer roller 35, a developing roller 31, a toner supply roller 32, and a toner tank 33. The transfer roller 35 is positioned above the photosensitive drum 30 and is rotatable while sandwiching the printing paper P between itself and the photosensitive drum 30. A transfer bias is applied to the transfer roller 35 for transferring a toner image from the photosensitive drum 30 to the printing paper P. The developing roller 31 is located so as to be in rotary contact with the photosensitive drum 30 further upstream in the direction of rotation of the photosensitive drum 30 than the transfer position between the photosensitive drum 30 and transfer roller 35. The toner supply roller 32 is located so as to be in rotary contact with the developing roller 31 at a point $\alpha$. The toner tank 33 is adapted to accumulate therein toners. In this developing unit 3, the photosensitive drum 30, developing roller 31, and toner supply roller 32 are all rotated clockwise in FIG. 1, for transporting the toner from the toner tank 33 toward the photosensitive drum 30 via the toner supply roller 32 and developing roller 31. In this developing unit 3, "against developing" or "counter developing" is performed in which rotating dir ction of th photosensitive drum 30 is opposite to that of the developing roller 31 at a toner supply point, i.e., at a position of contact $\beta$ between the photosensitive drum 30 and developing roller 31).

The developing unit 3 includes a layer thickness regulation blade 34 that is supported above the developing roller 31 for regulating a thickness of a toner layer on the developing roller 31. Thus, a toner image of uniform density can be formed on the photosensitive drum 30, since an electrostatic image formed on the surface of the photosensitive drum 30 is developed by the toner that is held uniformly on the developing roller 31 by means of this layer thickness regulation blade 34.

The developing unit 3 also includes a positively-charging scorotoron type charger 36 disposed below the photosensitive drum 30. The charger 36 is provided with a discharge wire of tungsten or the like and a grid electrode. The outer surface of the photosensitive drum 30 is evenly charged by this charger 36. A laser beam L modulated in accordance with image data by the scanner unit 5 scans this charge area, and an electrostatic latent image is formed on the surface of the photosensitive drum 30. When the electrostatic latent image is developed with toner supplied from the developing roller 31, that toner image is transferred to the printing paper P, passing between th transfer roller 35 and photosensitive drum 30, by means of the transfer roller 35 to which a transfer bias different from the potential of the photosensitive drum 30 is applied.

The developing unit 3 also includes a cleaning roller 37 and a diselectrification lamp 38. The cleaning roller 37 is located downstream of the transfer position between the photosensitive drum 30 and transfer roller 35 in the direction of rotation of the photosensitive drum 30. The cleaning roller 37 is in rotary contact with the photosensitive drum 30. The diselectrification lamp 38 is located between the developing unit 3 and the fixing device 4 for diselectrifying the photosensitive drum 30. After a toner image has been transferred to the printing paper P, the surface of the photosensitive drum 30 is first diselectrified by the diselectrification lamp 38, and then toner remaining on the surface is recovered by the cleaning roller 37. Inside the toner tank 33 is fitted a toner sensor 39 that protrudes upward from the lower part of the tank, enabling the presence or absence of toner in the toner tank 33 to be detected.

The scanner unit 5 includes a laser emitting section (not shown), a polygonal mirror 50, a lens 52, and reflecting mirrors 51, 51. A laser beam L emitted from the laser emitting section is applied to the outer surface of the photosensitive drum 30 in the developing unit 3 via the polygonal mirror 50, reflecting mirror 51, the lens 52, and the other reflecting mirror 51.

The fixing device 4 includes a protection cover 42, a heat roller 40 and the pressure roller 41 those disposed in the protection cover 42, and an infrared radiation sensor 43. A pair of discharge rollers 12, 13 are provided at a downstream side of the protection cover 42 in the sheet feeding direction. The fixing device 4 heats printing paper P, on which a toner image has been formed, by nipping the printing paper P between the heat roller 40 and the pressure roller 41, and fixes the toner image onto the printing paper P. Then the pair of discharge rollers 12 and 13 eject the printing paper P on which the toner image has been fixed into a paper discharge tray (not shown).

Figure 2:
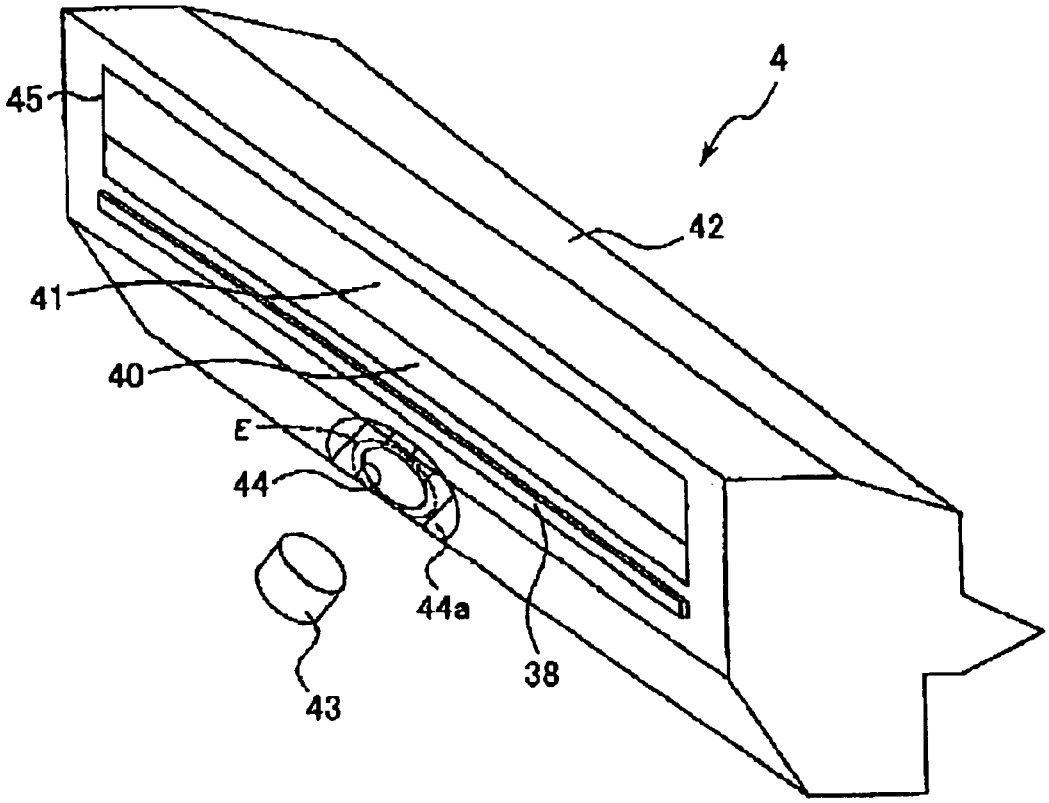
FIG. 2 is a schematic perspective view showing a fixing unit according to a first embodiment of the present invention.
Figure 3:
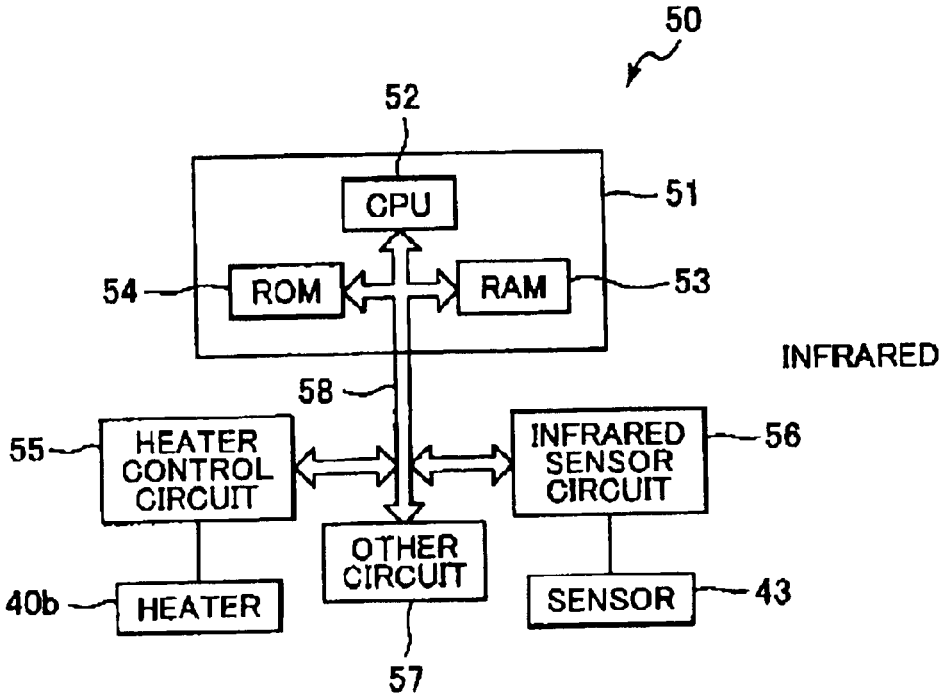
FIG. 3 is a block diagram showing a control device in the laser printer of FIG. 1.
Figure 4:
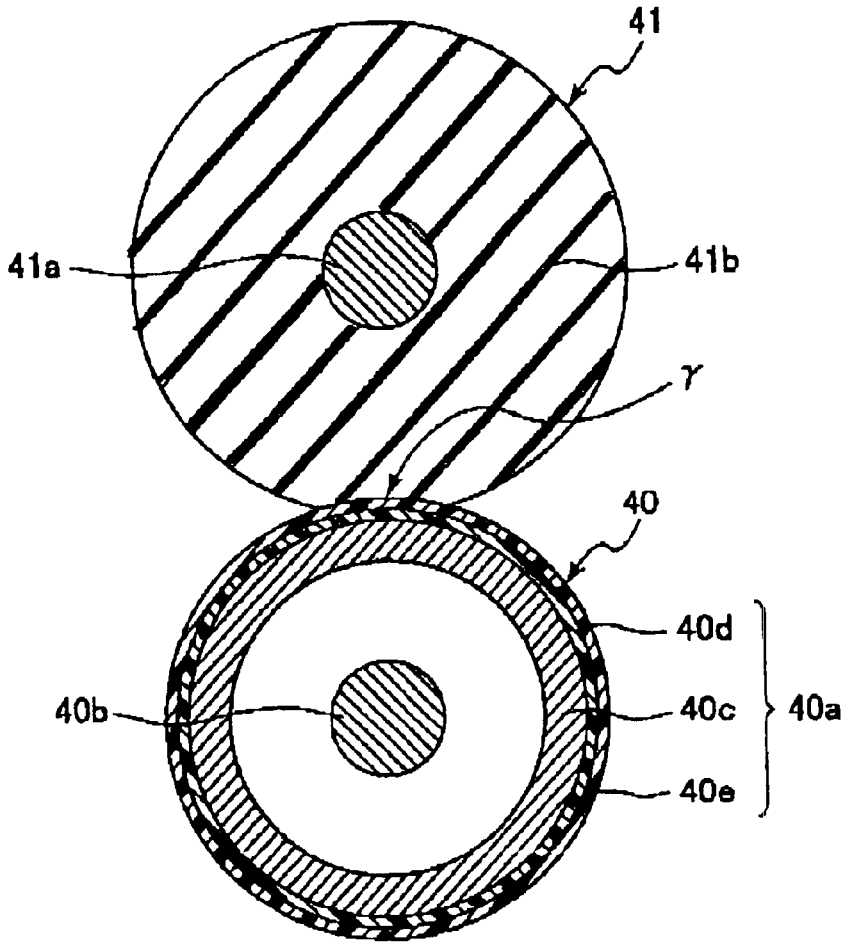
FIG. 4 is a vertical cross-sectional view showing a heat roller and a pressure roller according to the first embodiment.

The fixing device 4 according to the first embodiment will be described. The heat roller 40 and the pressure roller 41 serve as a fixing component. As shown in FIG. 4 the heat roller 40 includes a hollow cylindrical roller section 40*a* and a heater section 40*b* such as a halogen lamp disposed in a hollow space of the roller section 40*a*. The pressure roller 41 includes a metal shaft 41*a* and a resilient roller section 41*b* formed thereover. As shown in FIG. 2, the protective cover 42 is formed of a black heat-resistant material in a box-like shape, and covers the entire heat roller 40 and pressure roller 41. This protective cover 42 thus prevents heat emitted from the heat roller 40 from being radiated to other ambient mechanisms in the printer body. An inlet aperture 45 is formed at an upstream side of the protective cover 42 in the sheet feed direction. Printing paper P is introduced into the interior of the protective cover 42 through the inlet aperture 45, and a toner image transferred to that input printing paper P is fixed onto the printing paper P by the heat roller 40 and pressure roller 41. A hole 44 serving as a detection window is formed in the lower part of the protective cover 42, and a colored section 44*a* colored white is formed around the hole 44.

The infrared sensor 43 is equipped with a thermopile element having an infrared radiation receiving surface. The sensor 43 is positioned in the printer body as shown in FIG. 1 such that the infrared radiation receiving surface can command a view of the heat roller 40 via the hole 44*a*. A part of the field of view of the infrared sensor 42 will be outside the hole 44 according to the position at which the infrared sensor 42 is located in the printer body as shown by the dotted line area indicated by the symbol $\epsilon$ in FIG. 2. The aforementioned white colored section 44*a* of the protective cover 42 is formed over a greater extent (the hatched area in FIG. 2) than the part $\epsilon$ outside the hole 44. The reason therefor will be described later. Incidentally, with regard to the non-contact type sensor, a type that detects an amount of temperature change requires opening and closing of a shutter provided between the sensor and the heat source during temperature detection, whereas the thermopile does not detect an amount of the temperature change but can detect a temperature value, rendering a shutter unnecessary and so simplifying the configuration and making possible low cost implementation.

Next, the control device of the laser printer 1 according to the embodiment will be described while referring to FIG. 4. The control device 50 includes a central control circuit 51, a heater control circuit 55, an infrared radiation sensor circuit 56, and other circuitry 57. These circuits 51, 55 through 57 are linked by a bus 58.

The central control circuit 51 includes a CPU 52, a RAM 53, and a ROM 54, and executes various kinds of control. The RAM 53 temporarily stores information relating to the voltage level of an electrical signal input from the infrared sensor circuit 56 (information relating to the received amount of infrared radiation). The ROM 54 stores various kinds of programs, such as a program that calculates the surface temperature of the heat roller 40, and a main drive control program.

The halogen lamp forming the heater section 40*b* is connected to the heater control circuit 55. ON/OFF control to the halogen lamp is performed by the main drive control program via the heater control circuit 55. The thermopile 43 is connected to the infrared radiation sensor circuit 56. When the thermopile element provided in the thermopile 43 receives infrared radiation, an electrical signal is output whose voltage level is in accordance with that received amount of radiation. The infrared radiation sensor circuit 56 then performs A/D conversion of the electrical signal, and outputs the resulting signal to the RAM 53 via the bus 58. Thus, information relating to the voltage level of the electrical signal output from the thermopile element is stored in the RAM 53.

When information relating to the voltage level of the electrical signal output from the thermopile element is stored in the RAM 53, the central control circuit 51 executes processing that calculates the surface temperature of the heat roller 40 by means of a calculation program. Then, when the surface temperature of the heat roller 40 is stored in the RAM 53 by the calculation program, the central control circuit 51 executes the main drive control program, performs ON/OFF control with respect to the heater 40*b* via the heater control circuit 55, whereupon the surface temperature of the heat roller 40 can be controlled to an optimum image fixing temperature.

In addition, the central control circuit 51 executes the main drive control program so as to perform rotation control with respect to the heat roller 40 via the other circuitry 57, and executes various kinds of control to form a toner image on the printing paper P.

In the fixing device 4 configured as described above, the infrared radiation sensor 43 is located on the outside of the protective cover 42, and therefore, the infrared radiation sensor 43 is protected from heat emitted from the heat roller 40. As a result, even if an infrared radiation sensor 43 provided with a thermopile element that is susceptible to heat is used, as in this embodiment, the infrared radiation sensor 43 is not affected by heat emitted by the heat roller, and so aberrations do not occur in the accuracy of infrared radiation detection by the infrared sensor 43. Thus, the fixing device 4 according to this embodiment enables the temperature of the heat roller 40 to be detected accurately.

Next, a detailed arrangement of the heat roller 40 according to the first embodiment will next be described.

As described above, the heat roller 40 is composed of the roller section 40*a* formed in a cylindrical shape and the heater section 40*b* disposed inside the roller section 40*a*.

The roller section 40*a* is formed in a laminated manner, being composed of a base layer 41*c* forming the base of the roller section 40*a* an adhesion/radiation layer 40*d* laid upon the outer surface of this base layer 40*c,* and a toner parting layer 40*e* laid upon the outer surface of the adhesion/radiation layer 40*d.*

The base layer 40*c* is formed of thermally conductive material such as aluminum for efficiently transferring heat emitted by the heater section 40*b* toward the outer surface of the base layer 40*c.* The adhesion/radiation layer 40*d* is formed of a material in which an adhesive (binder) is mixed with a black pigment composed of carbon fibers. An infrared emissivity of the black pigment is higher than the infrared emissivity of aluminum (0.02). Therefore, when heat is transferred from the heater section 40*b* via the base layer 40*c,* the radiation layer 40*d* emits more infrared radiation than the base layer 40*c.* Further, the adhesion/radiation layer 40*d* serves to provide the toner parting layer 40*e* over the base layer 40*c* because the adhesive is mixed in the adhesion/radiation layer 40*d.*

The toner parting layer 40*e* is formed of fluororesin. The fluororesin is a so-called parting material, and prevents toner that has been melted during fixing operation from adhering to the heat roller 40. This fluororesin is also colorless and transparent, and allows good passage of infrared radiation emitted from the radiation layer 40*d.* Thus any decrease in the emitted amount of infrared radiation due to the toner parting layer 40*e* can be ignored.

Assuming that the carbon fibers are not contained in the adhesion layer 40*d.* The amount of infrared radiation emitted by an object is determined by the temperature of the object and the emissivity specific to that object. With the heat roller composed of base aluminum layer, the adhesion layer and the toner parting layer, in particular, the emissivity of the aluminum of which the base layer is composed is low such as 0.02 on average, and the toner parting layer applied to the outer surface of the base layer is generally colorless and transparent and also has low emissivity, so that the amount of infrared radiation emitted from the heat roller without the radiation layer is comparatively small. Therefore, the thermopile is consequently susceptible to adverse effects of the kind of noise component described above.

The reason why the emissivities of aluminum and the toner parting layer are low is as follows:

Part of the radiant energy incident on a layer of a particular material is reflected ($E_\rho$) by the surface of the layer, part is absorbed ($E_a$) in the layer on passing through the layer, and the remainder transmits ($E_\tau$) through the layer. According to the law of conservation of energy, the incident energy ($E_i$) is expressed by the following equation (1).

$$E_i=E_a+E_\rho+E_\tau \tag{1}$$

Dividing both sides by $E_i$ gives:

$$1=(E_a/E_i)+(E_\rho/E_i)+(E_\tau/E_i)=a_\lambda+\rho_\lambda+\tau_\lambda \tag{2}$$

where $a_\lambda$: absorptivity, $\rho_\lambda$: reflectivity, and $\tau_\lambda$: transmissivity.

Generally, according to Kirchhoff's law, absorptivity $a_\lambda$ is known to be equal to emissivity. Therefore, since aluminum and other metals have a high reflectivity $\rho_\lambda$, and the colorless and transparent materials have a high transmissivity $\tau_\lambda$, both have low emissivity.

In the first embodiment, since the adhesion layer 40*d* also serves as radiation layer and the radiation layer 40*d* is provided outside of the base layer 40*c,* resultant heat roller 40 can provide high emissivity, and emits a greater amount of infrared radiation.

The heater section 40*b* is composed of halogen lamp formed in an elongate shape, and located on the rotation axis of the roller section 40*a.*

The pressure roller 41 is located on the upward side with respect to the printing paper P transport path (see FIG. 1), and, as shown in FIG. 4, includes an elastic layer 41*b* composed of silicone rubber formed around a rotation shaft 41*a.* This pressure roller 41 is positioned so as to press against the heat roller 40. The elastic layer 41*b* undergoes elastic deformation and forms a nip γ that transmits heat, transmitted from the heat roller 40, to the printing paper P.

The protective cover 42 used in the embodiment is black, and therefore emits a large amount of infrared radiation, which may affect detection accuracy of the infrared radiation sensor 43. However, in the present embodiment, the white colored section 44*a* is formed around the hole 44, and the area of the white colored section 44*a* is greater than the maximum field of view of the infrared sensor 43. Therefore, even if a part of the field of view in which the infrared sensor 43 detects infrared radiation is outside the hole 44, the amount of emitted infrared radiation is suppressed at the white colored section 44*a.* Furthermore, the amount of emitted infrared radiation emitted from this colored section 44*a* is extremely small compared with the amount of infrared radiation emitted from the radiation layer 40*d* of the heat roller 40, and even if infrared radiation emitted from this colored section 44*a* is received as a noise component, the amount is excessively small. Thus, in this embodiment, even though the infrared sensor 43 is located on the outside of the protective cover 42, the infrared sensor 43 is able to receive an ample amount of infrared radiation necessary for detecting the temperature of the heat roller 40, and moreover the received noise component is small. Therefore, use of the fixing device 4 according to the embodiment enables the temperature of the heat roller 40 to be detected accurately.

Further, in the first embodiment, the outer toner parting layer itself may be formed of a material with low radiating capability as long as that material has good toner releasability, and furthermore the radiation layer may be formed of material with low releasability as long as that material has high radiating capability. Both the infrared radiation characteristics and the releasability of the fixing member can be improved by emphasizing the respective functions and choosing the most suitable material. Moreover, the aforementioned radiation layer contains adhesive, and therefore, intended laminating structure can be easily provided.

Figure 5:
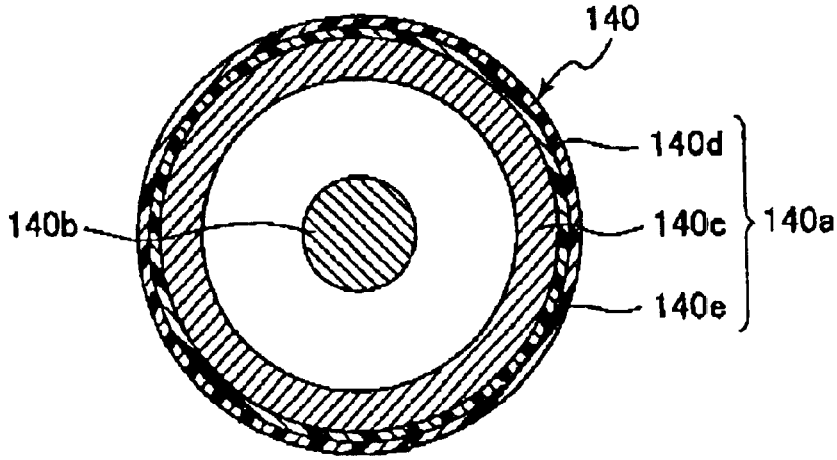
FIG. 5 is a vertical cross-sectional view showing a heat roller according to a second embodiment of the present invention.

A fixing device including a heat roller according to a second embodiment will be described with reference to FIG. 5. A roller section 140*a* of the heat roller 140 includes a base aluminum layer 140*c,* an adhesion layer 140*d* and a toner parting/radiation layer 140*e.* The base aluminum layer 140*c* is the same as the base layer 40*c* of the first embodiment. The toner parting/radiation layer 140*e* is formed of a mixture of fluororesin and a black pigment composed of carbon fibers. As the infrared emissivity of the black pigment is higher than the infrared emissivity of aluminum that forms the base layer 140*c,* when heat is transferred from the heater section 40*b* via the base layer 140*c,* the radiation layer 140*e* emits more infrared radiation than the base layer 140*c.* In the second embodiment, since the toner parting layer 140*e* also serves as the radiation layer, overall lamination structure becomes simple and production steps can be decreased. decreased.

The adhesion layer 140*d* is provided to bond the base layer 140*c* with the toner parting/radiation layer 140*e*. The adhesion layer 140*d* is formed of adhesive material only. However, the adhesion layer 140*d* can be formed of a mixture of adhesive and a black pigment composed of carbon fibers similar to the adhesion/radiation layer 40*d* of the first embodiment.

Figure 6:
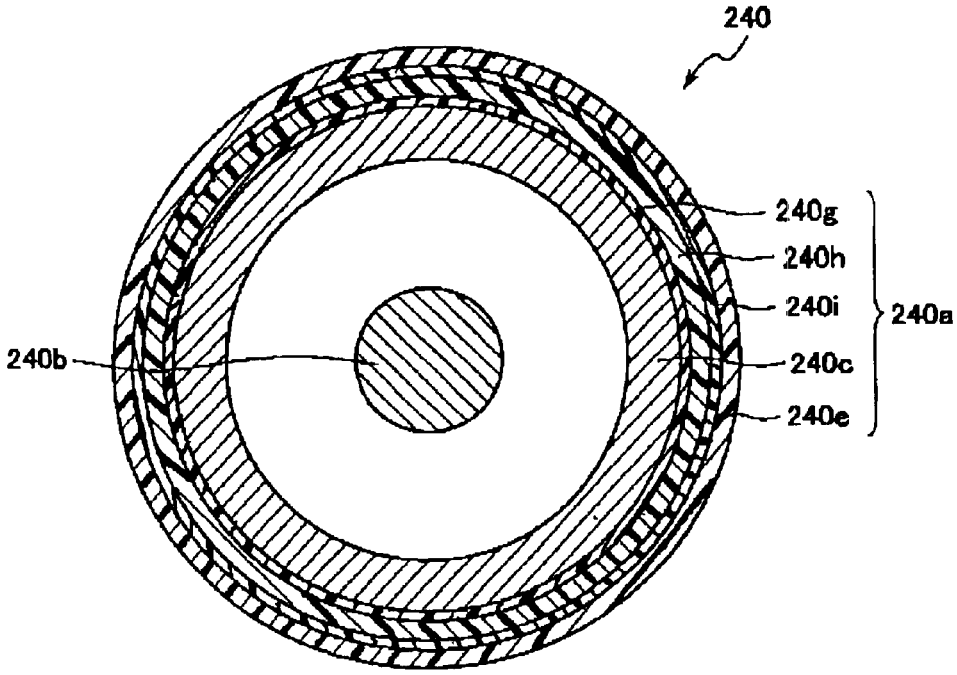
FIG. 6 is a vertical cross-sectional view showing a heat roller according to a third embodiment of the present invention.

A fixing device including a heat roller according to a third embodiment will be described with reference to FIG. 6. A roller section 240*a* of the heat roller 240 includes a base aluminum layer 240*c,* a first adhesive layer 240*g* laid upon the outer surface of the base layer 240*c,* a resilient/radiation layer 240*h* laid upon the first adhesive layer 240*g,* a second adhesive layer 240*i* laid upon the radiation layer 240*h,* and a toner parting layer 240*e* laid upon the second adhesive layer 240*i*.

The base layer 240*c* and toner parting layer 240*e* are the same as those 40*c,* 40*e* in the first embodiment. The first and second adhesive layers 240*g* and 240*i* are colorless and transparent to infrared radiation.

The resilient/radiation layer 240*h* is formed of a material in which a black pigment composed of carbon fibers is mixed with an elastic material composed of colorless and transparent heat-resistant silicone rubber. As the infrared emissivity of the black pigment is higher than the infrared emissivity of aluminum (0.02), when heat is transferred from a heater section 240*b* via the base layer 240*c,* the radiation layer 240*h* emits more infrared radiation than the base layer 240*c*. Also, as this radiation layer 240*b* contains silicone rubber, when the pressure roller 41 (FIG. 4) presses against the heat roller 240, the radiation layer 240*h* undergoes elastic deformation, and forms a larger nipping area than in the foregoing embodiments which do not provide resilient layer in the heat roller. Thus, according to the third embodiment, a larger nip can be formed, so that a heat applying length to the paper P can be extended, thereby enabling faster printing to be performed than in the case of the fixing device 4 according to the foregoing embodiments.

Also, in the third embodiment, since there is the first adhesive layer 240*g* between the base layer 240*c* and radiation layer 240*h,* and the second adhesive layer 240*i* between the radiation layer 240*h* and toner parting layer 240*e,* different kinds of layers can be laminated, enabling a laminated structure of the roller section 240*a* to be formed easily.

The third embodiment can be modified into various fashions. First, a pigment may be mixed into at least one of first and second adhesive layers 240*g* and 240*i* and the toner parting layer 240*e* to serve at least one of these layers as radiation layer(s). However, it should be noted that a resultant emissivity of the heat roller is determined by an outermost radiation layer if the outermost radiation layer has the highest emissivity.

Second, a pure resilient layer can be provided instead of the resilient/radiation layer 240*h,* and one of the first and second adhesive layers 240*g* and 240*i* can be adhesion/radiation layer(s) by the mixture of the adhesive and the carbon fiber.

Third, a pure resilient layer can be provided instead of the resilient/radiation layer 240*h,* and the toner parting layer 240*e* can be toner release/radiation layer by the mixture of the adhesive and the fluorine resin.

Fourth, instead of the heat-resistant silicone rubber as an elastic material, a fluororubber, and other equivalent material is available. In any event, the outermost radiation layer can function as the radiation layer.

A fixing device including a heat roller according to a fourth embodiment will be described with reference to FIG. 7. A roller section 340*a* of the heat roller 340 includes a base layer 340*c*1, a plating layer 340*c*2 laid upon the outer surface of the base layer 340*c*1 for plating the base layer 340*c*1, an adhesion/radiation layer 340*d* laid upon the plating layer 340*c*2, and a toner parting layer 340*e* laid upon the outer surface of the adhesion/radiation layer 340*d*.

The base layer 340*c*1 is formed of iron. Therefore, the base layer 340*c*1 efficiently transfers heat emitted by a heater section 340*b* toward the outer surface of the base layer 340*c*1. The plating layer 340*c*2 is formed of nickel for preventing the iron base layer 340*c*1 from corrosion.

The adhesion/radiation layer 340*d* is formed of a mixture of a black pigment and adhesive. As the infrared emissivity of the black pigment is higher than the infrared emissivity of nickel (0.02), the adhesive/radiation layer 340*e* emits more infrared radiation than the plating layer 340*c*2 when heat is transferred from the heater section 340*b* via the plating layer 340*c*2. The toner parting layer 340*e* is formed of fluororesin and is similar to the toner parting layer 40*e* of the first embodiment.

In the fourth embodiment, even though the roller section 340*a* has a plating layer 340*c*2, the adhesion/radiation layer 340*d* emits more infrared radiation than the plating layer 340*c*2, and therefore the effect similar to that of the first embodiment can be attained. Further, the plating layer 340*c*2 will play a role of preventing oxidation of the base layer 340*c*1, or a role of improving thermal conductivity in the base layer surface. In addition, as the infrared emissivity of the radiation layer 340*d* is higher than that of the plating layer 340*c*2, the temperature sensor will receive infrared radiation emitted from the radiation layer 340*d,* and the plating layer 340*c*2 will not adversely affect the accuracy of temperature detection by the temperature sensor.

Also, since the radiation layer 340*d* contains adhesive, laminated layer structure including the plating layer 340*c*2, radiation layer 340*d,* and the toner parting layer 340*e* can be easily provided. Furthermore, although rust-prone iron is used for the base layer 340*c*1, the plating layer 340*c*2 can avoid oxidation of the iron base layer 340*c*1. Incidentally, the toner parting layer 340*e* can provide radiation layer function by mixing carbon fiber with the fluororesin.

Figure 8:
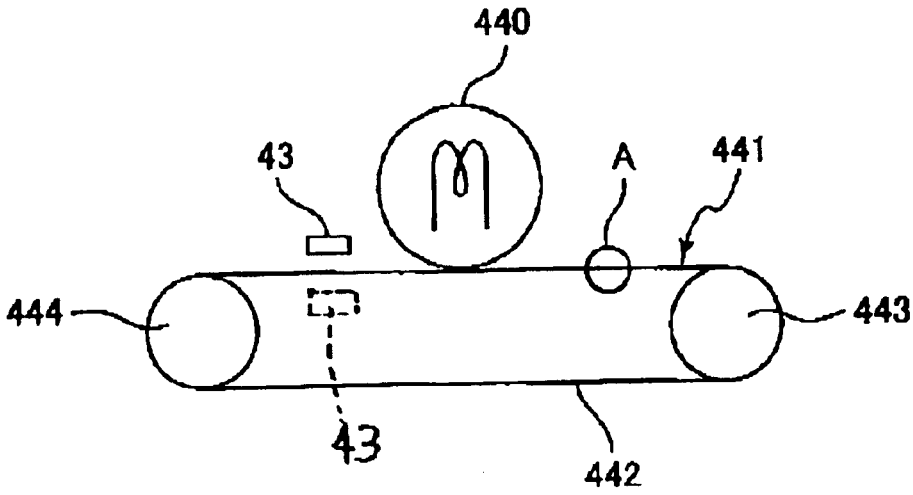
FIG. 8 is a schematic side view showing a fixing device including a heat roller and a pressure belt according to a fifth embodiment of the present invention.

A fixing device according to a fifth embodiment of the present invention will be described with reference to FIGS. 8 and 9. In the foregoing embodiments, the fixing device includes the upper pressure roller and the lower heat roller. However, in the fifth embodiment, the fixing device includes an upper heat roller 440 and a lower pressure belt arrangement 441 provided with a pressure belt 442. Further, in the foregoing embodiments, the infrared radiation sensor 43 detects the temperature of the heat roller, whereas in the fifth embodiment, the infrared radiation sensor 43 detects a temperature of the pressure belt 442. Obviously, temperature relationship is established between the heat roller 440 and the pressure belt 442 because the latter is in pressure contact with the heat roller 440. For example, the pressure belt 442 has a temperature about 10 to 20° C. lower than the temperature of the heat roller 440. If the temperature sensor cannot detect the temperature from the heat roller 440 due to geometrical arrangement or the like, temperature control to the heat roller 440 can be made based on the detection of temperature from the pressure belt 442.

In the fifth embodiment, any one of the above-described heat rollers in the foregoing embodiments is available as the heat roller 440. The heat roller 440 is located on the upper side of the printing paper P. The pressure belt arrangement 440 is located on the lower side of the printing paper P, and includes two pressure belt rollers 443 and 444, and the pressure belt 442 mounted on these pressure belt rollers 443 and 444. The heat roller 440 is positioned so as to be in contact with the pressure belt 442.

Figure 9:
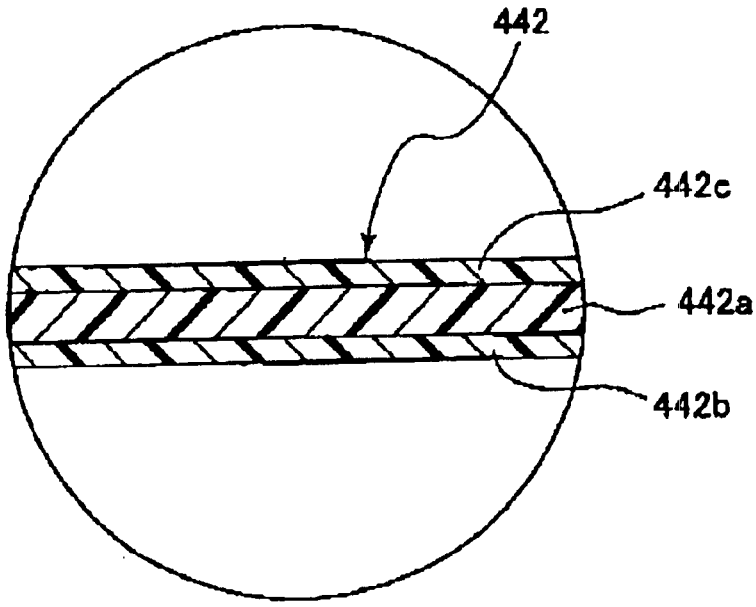
FIG. 9 is an enlarged cross-sectional view showing the pressure belt marked by a circle A of FIG. 8 in the fifth embodiment.

The pressure belt 442 is formed in a laminated manner as shown in FIG. 9, and is composed of a central base layer 442*a,* a toner parting layer 442*c* laid on an outer surface of the base layer 442*a,* and a radiation layer 442*b* laid on an inner surface of the base layer 442*a*. The base layer 442*a* is formed of polyimide. The transmissivity of polyimide with respect to infrared radiation is on the order of 0.5 for colored transparent polyimide and 0.9 for colorless and transparent polyimide. Thus, infrared radiation emitted from the radiation layer 442*b* can be passed efficiently through the base layer 442*a* to the toner parting layer 442*c*.

The radiation layer 442*b* is formed of a black pigment composed of carbon fibers. As the infrared radiation emissivity of the black pigment is higher than the emissivity of polyimide (0.5 in the case of colored transparent polyimide, 0.1 in the case of colorless and transparent polyimide), the radiation layer 442*b* emits more infrared radiation than the base layer 442*a* when heat is applied from the heat roller 440 via the base layer 442*a*.

The toner parting layer 442*c* is formed of fluororesin. The fluororesin is a so-called a parting agent, and prevents toner that has been melted for fixing toner image onto printing paper P from adhering to the pressure belt 442. The fluororesin is also colorless and transparent, and allows good passage of infrared radiation emitted from the radiation layer 442*b*. Thus any decrease in the emitted amount of infrared radiation can be ignored.

The infrared radiation sensor 43 receives infrared radiation emitted from the surface of the pressure belt 442. In this embodiment, the sensor 43 is positioned in confrontation with the toner parting layer 442*c*.

In the fifth embodiment, since the heat roller 440 is pressed against the pressure belt 442, the pressure belt 442 easily undergoes elastic deformation, and a nip can be formed easily. Moreover, a large nip area can be provided, since the belt 442 is easily deformed in conformance with the contour of the heat roller 440, which enables faster printing to be performed.

Also, since the radiation layer 442*b* is formed of black pigment composed of carbon fibers and has infrared emissivity higher than the infrared emissivity of the base layer 442*a,* the radiation layer 442*b* emits more infrared radiation than the base layer 442*a* when heat is transferred from the heat roller 440 via the base layer 442*a*. Thus, in the fifth embodiment, the infrared sensor 43 can be located on the outside of the protective cover 42 (FIG. 1), but still can receive an ample amount of infrared radiation necessary for detecting the temperature of the heat roller 440, with a lesser noise component. Consequently, the temperature of the heat roller 440 can be detected accurately.

Further, in the fifth embodiment, because the base layer 442*a* is interposed between the toner parting layer 442*c* and the radiation layer 442*b,* there is no problem if the toner parting layer and radiation layer are formed of materials whose mutual contact is best avoided. Also, if the toner parting layer and radiation layer are formed of materials that are difficult to bond together, providing an intermediate base layer that bonds easily with both will make it possible to ensure the bonding strength of the laminated structure.

While the invention has been described in detail with reference to specific embodiments thereof, it would be apparent to those skilled in the art that various changes and modifications may be made therein without departing from the spirit of the invention. For example, in the above-described embodiments, carbon fiber is used as the material of the radiation layers, since a black color is desirable. However, the color of radiation layers may be any color, such as brown, green, gray, blue, ultramarine, yellow ocher, or the like, as long as the emissivity is 0.02 or higher. Therefore, any pigment may be used giving any of these colors, such as low-cost, red ferric oxide, for example. Also, the emissivity of radiation layers should be greater than the maximum emissivity of the metal of which the base layer or the plating layer is composed. For example, in the case of aluminum, for example, the emissivity of the radiation layer should be not less than 0.02, and preferably, not less than 0.5, and more preferably, not less than 0.8.

As a material of the toner parting layer fluororesins such as tetrafluoroethylene perfluoroalkyl vinyl ether copolymer resin (PFA), tetrafluoroethylene hexafluoropropylene copolymer resin (FEP), polytetrafluoroethylene copolymer resin (PTFE), and so forth is available, but as long as releasability is secured. However, materials are not, of course, limited to these.

Further, with regard to the colored section 44*a,* an entire area within the field of view need not be colored white, but a part within the field of view of the infrared sensor 43 is colored white, since the amount of infrared radiation emitted from that part can be suppressed.

Further, the infrared sensor 43 can be located inside the protective cover 42. In this case, the entire inner surface of the protective cover 42 may be colored white or a similar color with low emissivity.

Further, in the first to fourth embodiments, the fixing temperature for fixing a toner image onto printing paper P is controlled by measuring the temperature on the heat roller. However, since the pressure rollers are also heated by the heat roller to a temperature close to that of the heat roller, it is also possible to measure the temperature of the pressure roller 41 by receiving infrared radiation emitted from the pressure roller, as in the fifth embodiment where the temperature of the pressure belt is measured.

Further, in the above-described embodiments, the hole 44 can be plugged with a material that is transparent to infrared radiation. If the latter case, the amount of infrared radiation received by the infrared sensor 43 does not change, and thus it is possible not only to measure the temperature of the heat roller accurately, but also to protect the infrared sensor 43 from heat emitted from the hole 44, enabling the temperature of the heat roller to be detected more accurately.

Further, in the first to fourth embodiments, there is a combination of two rollers, in the form of a heat roller plus pressure roller, with the heat source (corresponding to the heater section) in one of the two. However, a heat source may also, of course, be provided in both rollers. In this case, the roller on which the surface temperature is detected by the thermopile 43 can be provided with a radiation layer.

Figure 7:
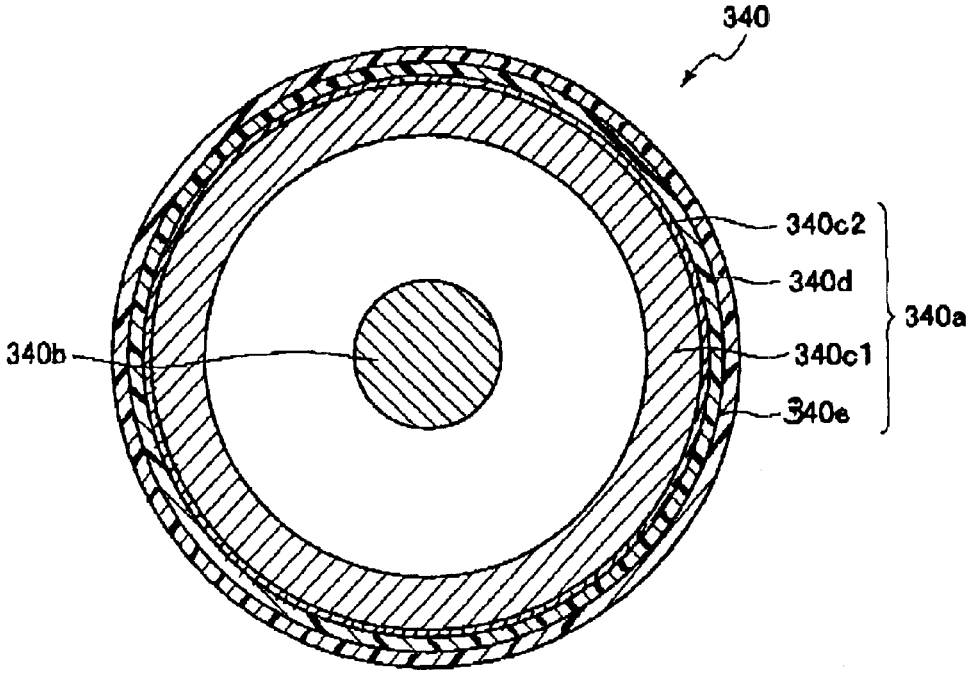
FIG. 7 is a vertical cross-sectional view showing a heat roller according to a fourth embodiment of the present invention.

Further, the fourth embodiment shown in FIG. 7 is a modification to the first embodiment shown in FIG. 4 in that the base layer of the first embodiment is subjected to plating. Such plating is also available to the base layers 140*c* (FIG. 4) and 240*c* (FIG. 6) of the second and third embodiments.

Figure 10:
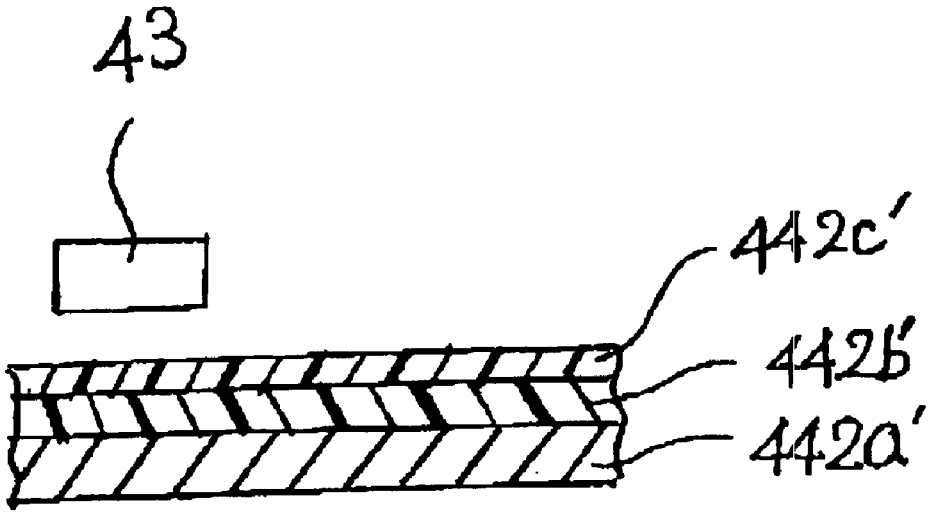
FIG. 10 is an enlarged cross-sectional view showing a pressure belt and an infrared sensor according to a modification to the fifth embodiment.

Further, the base layer of the pressure belt in the fifth embodiment is formed of a polyimide. However, as a modification to the fifth embodiment, in a pressure belt 442', a base layer 442*a*' can be formed of a metal as shown in FIG. 10, such as nickel electroforming. In the latter case, a radiation layer 442*b*' can be formed further outward than the base layer 442*a*' provided that the sensor 43 is disposed outside of the pressure belt 442, because metal cannot transmit light. A toner parting layer 442*c*' is laid on an outer surface of the radiation layer 442*b*'. In other words, the temperature sensor can be positioned inside of the belt if the radiation layer is positioned at inner side of the metallic base layer.

Further, in the fifth embodiment, the sensor 43 can be positioned inside of the pressure belt 442 as shown by a broken line in FIG. 9 as long as the base layer 442*a* is formed of polyimide, since polyimide can allow infrared radiation to pass therethrough.

Further, in the fifth embodiment, instead of the combination of the heat roller and the pressure belt, heat source can be provided also to the pressure belt. In the latter case, the side on which the surface temperature is detected by the temperature sensor must be provided with the radiation layer.

Further in the foregoing embodiments, a combination of roller plus roller or roller plus belt, is provided. However, a combination of belt plus belt may, of course, also be used in these embodiments. In the latter case, also, the side on which the surface temperature is detected by the temperature detecting means can be provided with a radiation layer.

Further, in the above-described embodiments, two rollers or a combination of roller and a belt are provided. However, it is also possible for the side equipped with a heat source not to be provided with a roller or belt-shaped mechanism, but for an electromagnetic induction heating (so-called IH type) heat source to be provided. In the latter case, the infrared sensor can be positioned so as to detect the temperature of one or other of the rollers or the belt.

Further, the plating layer employed in the forth embodiment can also be used in the other embodiments if the base layer is formed of a corrosive material. For example, in the first embodiment, the base layer is formed of iron layer and a plating layer formed over the iron layer, and the adhesion/radiation layer 40*d* should provide the infrared emissivity higher than that of the plating layer. In other words, in the forth embodiment, the base layer is composed of the base material layer 340*c*1 and the plating layer 340*c*2.

Further, the present invention is not limited to a laser printer, but may be similarly applied to a device that forms an image by electrophotography, such as a facsimile machine or a photocopier, and to a laminator that protects printing paper, photographs, and the like, with laminating film. In this case, the printing paper, etc., corresponds to the fixable medium of the present invention, and the laminating film corresponds to the receiving medium.

What is claimed is:

1. A fixing device for heatingly fixing a fixable medium to a receiving medium, comprising:

a fixing unit that heats and presses the fixable medium onto the receiving medium, the fixing unit emitting infrared radiation as a result of heating and comprising a lamination structure component including at least a base layer having a surface and a radiation layer with an infrared emissivity higher than that of the surface of the base layer; and a temperature sensor unit that detects a temperature of the fixing unit based on the infrared radiation, and positioned spaced away from the fixing unit while enabling reception of the infrared radiation emitted from the radiation layer.

2. The fixing device as claimed in claim 1, wherein the base layer is made from a single material.

3. The fixing device as claimed in claim 1, wherein the base layer is made from a metal.

4. The fixing device as claimed in claim 3, wherein the surface of the base layer is subjected to plating to provide a plating layer, the radiation layer providing an infrared emissivity higher than that of the plating layer.

5. The fixing device as claimed in claim 1, wherein the radiation layer is tinted.

6. The fixing device as claimed in claim 5, wherein the radiation layer contains a black pigment.

7. The fixing device as claimed in claim 6, wherein the black pigment contains carbon fibers.

8. The fixing device as claimed in claim 1, wherein the radiation layer is formed over the base layer, and wherein the lamination structure component further comprises a surface layer formed over the radiation layer and made from a parting agent that prevents the fixable medium from being adhered onto a surface of the surface layer and allows the infrared radiation emitted from the radiation layer to pass through the surface layer.

9. The fixing device as claimed in claim 8, wherein the radiation layer is made from an adhesive mixed with a coloring agent.

10. The fixing device as claimed in claim 9, wherein the coloring agent comprises a black pigment.

11. The fixing device as claimed in claim 10, wherein the black pigment comprises carbon fibers.

12. The fixing device as claimed in claim 8, wherein the surface of the base layer is subjected to plating to provide a plating layer, the plating layer being positioned between the base layer and the radiation layer.

13. The fixing device as claimed in claim 12, wherein the radiation layer provides an infrared emissivity higher than that of the plating layer.

14. The fixing device as claimed in claim 3, wherein the radiation layer is mainly made from a parting agent.

15. The fixing device as claimed in claim 14, wherein the parting agent is mixed with a coloring agent.

16. The fixing device as claimed in claim 15, wherein the parting agent comprises a fluororesin, and the coloring agent comprises a black pigment.

17. The fixing device as claimed in claim 16, wherein the black pigment comprises carbon fibers.

18. The fixing device as claimed in claim 14, further comprising an adhesion layer provided between the base layer and the radiation layer.

19. The fixing device as claimed in claim 14, wherein the surface of the base layer is subjected to plating to provide a plating layer, the plating layer being positioned between the base layer and the radiation layer.

20. The fixing device as claimed in claim 19, wherein the radiation layer provides an infrared emissivity higher than that of the plating layer.

21. The fixing device as claimed in claim 3, wherein the radiation layer is formed over the base layer, and wherein the lamination structure component further comprises a surface layer formed over the radiation layer and made from a parting agent that prevents the fixable medium from being adhered onto a surface of the surface layer, the radiation layer containing an elastic material.

22. The fixing device as claimed in claim 21, wherein the radiation layer further contains a coloring agent.

23. The fixing device as claimed in claim 22, wherein the elastic material comprises a silicone rubber, and the coloring agent comprises a black pigment.

24. The fixing device as claimed in claim 23, wherein the black pigment comprises carbon fibers.

25. The fixing device as claimed in claim 21, wherein the lamination structure component further comprises an adhesion layer provided between the radiation layer and the surface layer.

26. The fixing device as claimed in claim 21, wherein the lamination structure component further comprises an adhesion layer provided between the base layer and the radiation layer.

27. The fixing device as claimed in claim 26, wherein the lamination structure component further comprises a second adhesion layer provided between the radiation layer and the surface layer.

28. The fixing device as claimed in claim 21, wherein the surface of the base layer is subjected to plating to provide a plating layer, the plating layer being positioned between the base layer and the radiation layer.

29. The fixing device as claimed in claim 28, wherein the radiation layer provides an infrared emissivity higher than that of the plating layer.

30. The fixing device as claimed in claim 3, wherein the radiation layer is formed over the base layer, and wherein the lamination structure component further comprises a surface layer and a resilient layer, the surface layer being made from a parting agent that prevents the fixable medium from being adhered onto a surface of the surface layer, and the resilient layer being formed over the radiation layer.

31. The fixing device as claimed in claim 30, wherein the radiation layer is mainly made from an adhesive agent and a coloring agent.

32. The fixing device as claimed in claim 31, wherein the coloring agent comprises a black pigment.

33. The fixing device as claimed in claim 32, wherein the black pigment comprises carbon fibers.

34. The fixing device as claimed in claim 30, wherein the surface of the base layer is subjected to plating to provide a plating layer, the plating layer being positioned between the base layer and the radiation layer.

35. The fixing device as claimed in claim 34, wherein the radiation layer provides an infrared emissivity higher than that of the plating layer.

36. The fixing device as claimed in claim 3, wherein the radiation layer is formed over the base layer, and wherein the lamination structure component further comprises a surface layer and a resilient layer, the surface layer being made from a parting agent that prevents the fixable medium from being adhered onto a surface of the surface layer, and the radiation layer being positioned between the resilient layer and the surface layer.

37. The fixing device as claimed in claim 36, wherein the radiation layer is mainly made from an adhesive agent and a coloring agent.

38. The fixing device as claimed in claim 37, wherein the coloring agent comprises a black pigment.

39. The fixing device as claimed in claim 38, wherein the black pigment comprises carbon fibers.

40. The fixing device as claimed in claim 36, wherein the surface of the base layer is subjected to plating to provide a plating layer, the plating layer being positioned between the base layer and the resilient layer.

41. The fixing device as claimed in claim 40, wherein the radiation layer provides an infrared emissivity higher than that of the plating layer.

42. The fixing device as claimed in claim 3, wherein the radiation layer is formed over the base layer, and wherein the lamination structure component further comprises a resilient layer positioned between the base layer and the radiation layer, the radiation layer containing a parting agent that prevents the fixable medium from being adhered onto a surface of the radiation layer.

43. The fixing device as claimed in claim 42, wherein the radiation layer further contains a coloring agent.

44. The fixing device as claimed in claim 43, wherein the parting agent comprises a fluororesin, and the coloring agent comprises a black pigment.

45. The fixing device as claimed in claim 44 wherein the black pigment comprises carbon fibers.

46. The fixing device as claimed in claim 42, wherein the lamination structure component further comprises an adhesion layer positioned between the radiation layer and the resilient layer.

47. The fixing device as claimed in claim 46, wherein the lamination structure component further comprises a second adhesion layer positioned between the resilient layer and the base layer.

48. The fixing device as claimed in claim 42, wherein the surface of the base layer is subjected to plating to provide a plating layer, the plating layer being positioned between the base layer and the resilient layer.

49. The fixing device as claimed in claim 48, wherein the radiation layer provides an infrared emissivity higher than that of the plating layer.

50. The fixing device as claimed in claim 3, wherein the lamination structure component further comprises a first adhesion layer formed upon the base layer, a resilient layer formed upon the first adhesion layer, a second adhesion layer formed upon the resilient layer, and a surface layer formed upon the second adhesion layer, one of the first adhesion layer, the resilient layer, the second adhesion layer, and the surface layer containing a coloring agent so that the color agent containing layer serves as the radiation layer.

51. The fixing device as claimed in claim 50, wherein the coloring agent comprises a black pigment.

52. The fixing device as claimed in claim 51, wherein the black pigment comprises carbon fibers.

53. The fixing device as claimed in claim 50, wherein the surface of the base layer is subjected to plating to provide a plating layer, the plating layer being positioned between the base layer and the resilient layer.

54. The fixing device as claimed in claim 53, wherein the radiation layer provides an infrared emissivity higher than that of the plating layer.

55. The fixing device as claimed in claim 1, wherein the laminated structure component is in the form of an endless belt.

56. The fixing device as claimed in claim 55, wherein the base layer is made from an infrared radiation transmittable material.

57. The fixing device as claimed in claim 56, wherein the base layer is made from polyimide.

58. The fixing device as claimed in claim 56, wherein the laminated structure component further comprises a surface layer with which the fixable medium is in contact, the base layer being provided between the surface layer and the radiation layer.

59. The fixing device as claimed in claim 56, wherein the endless belt defines an internal space, and wherein the temperature sensor is positioned in the internal space and is confrontation with the radiation layer.

60. The fixing device as claimed in claim 55, wherein the temperature sensor is positioned at a side where the radiation layer is positioned with respect to the base layer.

61. The fixing device as claimed in claim 58, wherein the radiation layer contains a coloring agent.

62. The fixing device as claimed in claim 61, wherein the coloring agent comprises a black pigment.

63. The fixing device as claimed in claim 62, wherein the black pigment comprises carbon fibers.

64. The fixing device as claimed in claim 1, wherein the temperature sensing unit has a light receiving surface providing a field of view, and the device further comprising a protective cover disposing therein the thermal fixing unit, the protective cover having an area viewable within the field of view, at least a part of the area having an infrared emissivity lower than that of the radiation layer.

65. The fixing device as claimed in claim 64, wherein the protective cover is formed with an opening for permitting the infrared radiation from the thermal fixing unit to be passed therethrough and transmitted to the light receiving surface, the opening being positioned within the field of view.

66. The fixing device as claimed in claim 65, wherein the at least part of the area is a region surrounding the opening.

67. The fixing device as claimed in claim 64, wherein at least the part of the area is colored white.

68. A fixing device for heatingly fixing a fixable medium to a receiving medium, comprising:

a fixing unit that heats and presses the fixable medium onto the receiving medium, the fixing unit emitting infrared radiation as a result of heating with its infrared emissivity;

a protective cover covering the fixing unit; and a temperature sensor unit that detects a temperature of the fixing unit based on the infrared radiation and positioned spaced away from the fixing unit while enabling reception of the infrared radiation emitted from the radiation layer, the temperature sensing unit having a light receiving surface providing a field of view, and the protective cover having an area viewable within the field of view, at least a part of the area having an infrared emissivity lower than that of the fixing unit.

69. The fixing device as claimed in claim 68, wherein the protective cover is formed with an opening for permitting the infrared radiation from the thermal fixing unit to be passed therethrough and transmitted to the light receiving surface, the opening being positioned within the field of view.

70. The fixing device as claimed in claim 69, wherein the at least part of the area is a region surrounding the opening.

71. The fixing device as claimed in claim 70, wherein at least the part of the area is colored white.

* * * * *